US009499374B2

(12) United States Patent
Hawkins et al.

(10) Patent No.: US 9,499,374 B2
(45) Date of Patent: Nov. 22, 2016

(54) WIRE REELS, COMPONENTS THEREOF, AND RELATED METHODS

(71) Applicants: Roland Wade Hawkins, San Saba, TX (US); Cindy Ann Hawkins, San Saba, TX (US); Daniel Tagtow, Austin, TX (US); Hugh Melling, Harbor Springs, MI (US)

(72) Inventors: Roland Wade Hawkins, San Saba, TX (US); Cindy Ann Hawkins, San Saba, TX (US); Daniel Tagtow, Austin, TX (US); Hugh Melling, Harbor Springs, MI (US)

( * ) Notice: Subject to any disclaimer, the term of this patent is extended or adjusted under 35 U.S.C. 154(b) by 132 days.

(21) Appl. No.: 14/057,815

(22) Filed: Oct. 18, 2013

(65) Prior Publication Data

US 2015/0108264 A1 Apr. 23, 2015

(51) Int. Cl.
*B65H 75/38* (2006.01)
*B65H 75/44* (2006.01)
*B65H 75/40* (2006.01)

(52) U.S. Cl.
CPC ..... *B65H 75/4494* (2013.01); *B65H 75/40* (2013.01); *B65H 75/446* (2013.01); *B65H 2701/364* (2013.01)

(58) Field of Classification Search
CPC ..... B65H 75/38; B65H 75/4431; B65H 75/4471; B65H 75/4492
USPC ..... 242/395.1, 404, 405.3, 406
See application file for complete search history.

(56) References Cited

U.S. PATENT DOCUMENTS

| | | | | | |
|---|---|---|---|---|---|
| 1,592,030 | A | * | 7/1926 | Langsner | 242/395.1 |
| 1,740,947 | A | * | 12/1929 | Langsner | 220/4.21 |
| 1,977,863 | A | * | 10/1934 | Simpson | 242/396.9 |
| 2,589,500 | A | * | 3/1952 | Landon et al. | 33/393 |
| 2,856,470 | A | * | 10/1958 | Hyde | 191/12.4 |
| 3,311,319 | A | * | 3/1967 | Campbell | 242/394 |
| 4,595,155 | A | * | 6/1986 | Gough | 242/395.1 |
| 5,388,877 | A | * | 2/1995 | Wenk | 294/219 |

* cited by examiner

*Primary Examiner* — Sang Kim
(74) *Attorney, Agent, or Firm* — The Villhard Patent Group

(57) ABSTRACT

Embodiments provide reels comprising covers, wire hubs, and winding levers. The covers removably attach to casings and close spool apertures of the casings. The hubs spool wire into/out of the apertures via windows of the casings. Moreover, the hubs couple to the covers. Some levers operably couple to the covers. When stowed, the levers are within the perimeters of the covers. When deployed, the levers extend beyond the perimeters. The reels can also comprise the casings. Mounting bases of some reels can removably attach to the casings. Furthermore, some levers can pivot about hinges on the covers. Levers can comprise wind knobs at their ends and the covers can define apertures through which the knobs extend when stowed. Detents which retain the levers in the stowed position can be provided. Moreover, hubs can comprise the detents for engaging the levers when the levers are stowed.

19 Claims, 12 Drawing Sheets

FIG 6
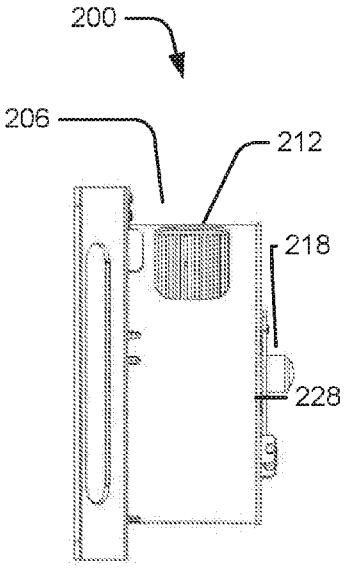
FIG 7
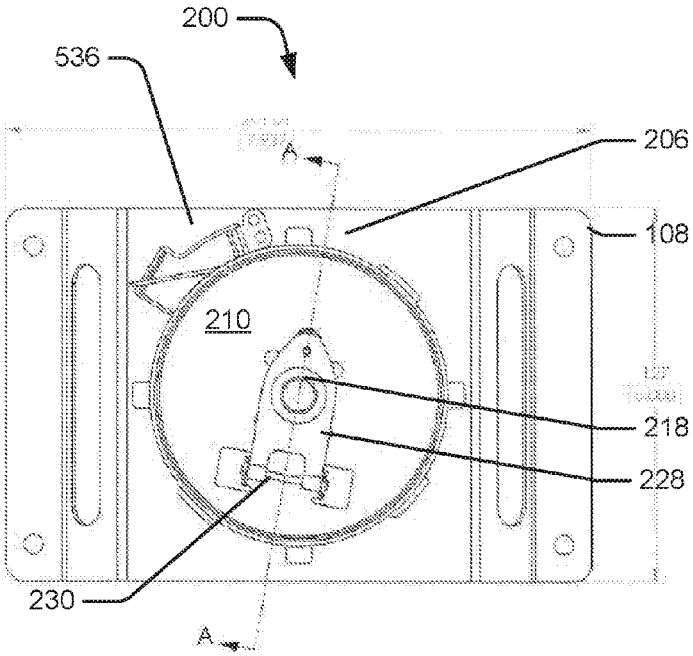
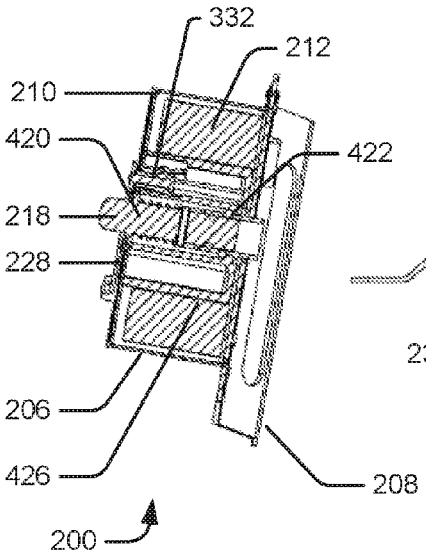
FIG 9
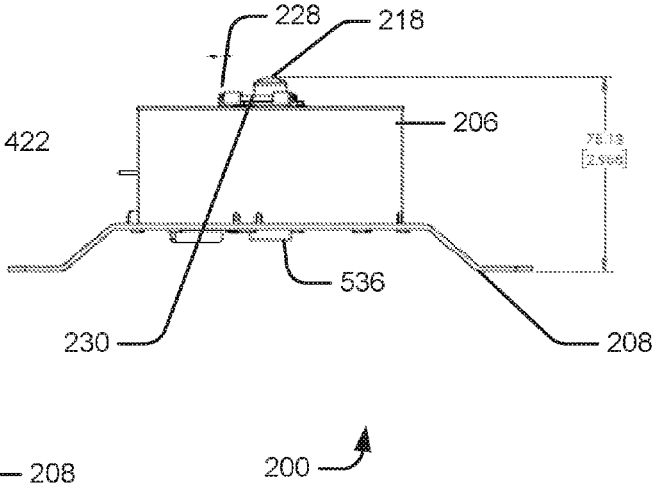
FIG 8

WIRE REELS, COMPONENTS THEREOF, AND RELATED METHODS

This application claims priority to and is a non-provisional application of U.S. patent application No. 61/809,689 filed on Apr. 8, 2013, titled "Quick Attach Wire Reel" by Roland Hawkins et al the entirety of which is incorporated herein as if set forth in full.

BACKGROUND

Good fences make good neighbors or so the saying goes. But to maintain a good fence efficiently requires a number of things including sturdy poles, good footings for them, and the ability (at least for non-barbed wire fences) to string wire quickly and conveniently between the poles. Moreover, many fence breaks occur hundred (if not thousands) of yards away from supplies of wire. The distances involved therefore make it at least inconvenient to return to a shop, barn, garage, depot, etc. to retrieve additional/different wire than that perhaps on hand in the field.

Additionally, fences on many ranches, farms, and other properties run through areas overgrown with, or at least partly overgrown with, brush. The presence of the brush (and/or other wire snagging material) often forces the fence mender to dismount and/or exit their vehicle to manually string the wire through the brushy area. Of course, as the worker strings the wire for the fence (particularly barbed wire) it is also desirable that the worker to tie the wire to the fence posts with wire or other material suitable for that purpose. Working with even these typically shorter strands of "tie" wire can lead to situations in which the brush ensnares the tie wire. In addition, the brush can ensnare or "snag" the wire reels that the worker might be using. These situations naturally lead to frustration on the part of the worker and also to a loss of productivity whenever the worker encounters a problematic area. Fence mending is but a stand in for many projects involving wire in which such situations might arise. For instance, it is often desirable to tie down mattresses, furniture, signs, etc. on top of a vehicle or in a truck bed for transport.

Perhaps, more importantly, the foregoing scenarios illustrates larger issues in that workers operate in many environments in which their wire reels snag on objects in (often) confined spaces. Each time such wire reels snag the workers have to back track enough to clear the snags before retracing ground already covered. Moreover, in doing so, the workers many times allow slack to develop in the wire being pulled thereby inviting further entanglements, snags, etc. These and other problems lead to a general loss of productivity and/or efficiency. More specifically, workers in commercial/industrial settings might find themselves pulling wire through crawlways, wire closets, raceways, attics, etc. all of which might be populated with snag-producing protrusions (and/or other traps for the wire and/or the wire reel).

Another aspect of wire pulling involves the desire to quickly change the type of wire used in various phases of certain projects. For instance, in commercial/industrial settings, a particular worker might need to pull wires of varying gauges through one common region (or many regions). With wire reels heretofore available, each time the worker wants to change wire gauges the worker must stop productive work to retrieve and/or change reels to accommodate the next gauge of wire to be pulled. Of course "gauge" is but a proxy in the foregoing scenarios for the many different types, colors, etc. of wire (and other elongated materials such as string, twine, rope, etc.) which a user might want to pull through a given area.

SUMMARY

The following presents a simplified summary in order to provide an understanding of some aspects of the disclosed subject matter. This summary is not an extensive overview of the disclosed subject matter, and is not intended to identify key/critical elements or to delineate the scope of such subject matter. A purpose of the summary is to present some concepts in a simplified form as a prelude to the more detailed disclosure that is presented herein. The current disclosure provides systems, apparatus, etc. comprising wire reels and, more particularly, reels for use in confined, brushy, and/or other areas for one or more of a variety of purposes. Moreover, wire reels of the current disclosure are not limited to any particular use.

Such wire reels can prevent wire from becoming tangled while in storage or transit. For instance, instead of allowing wire to lay in a truck bed, in a warehouse, in a laydown yard, etc. where it can become tangled with itself and/or other elongated materials, embodiments allow the wire to be stored in a wire reel. Features of some embodiments can prevent expending time and manpower untangling the wire prior to its use. Additionally, or in the alternative, these features prevent waste in that some wire might be tangled beyond salvage in their absence.

Moreover, embodiments provide wire reels with quick attachment/detachment features. In some embodiments, the wire reels (including their casings) couple/decouple to/from mounting bases (or buckles) via some form of quick attachment fitting. In some embodiment, the covers of the wire reels and the spools of wire operatively coupled thereto attach to (and detach from) the casings via quick attachment fittings. Wire reels of some embodiments, moreover, comprise quick attachment/detachment fittings for both purposes.

For instance, a ball-detent mechanism can be used as the quick attachment fitting between a mounting base and the wire reel. In such cases, the male portion of the fitting can be located on the spindle of the reel. The female portion would correspondingly be located on the mounting base or on a base of the reel. For the quick attachment fitting between the cover and the spindle, a ball-detent mechanism or a bayonet fitting could be used. Other types of quick attachment mechanisms, however, can be used for either or both purposes. For instance, one embodiment includes commonly actuated ball-detent mechanisms in both locations. The common actuator can be configured such that actuating it to a first extent can actuate one of the mechanisms while actuating it to another extent can actuate the other mechanisms.

Some embodiments provide wire reels with quick attachment/detachment mechanisms for dispensing and/or re-winding differing types and/or gauges of wires in agricultural, electrical, sports, do-it-yourself, etc. settings. Wire reels of some embodiments provide face-plates and/or covers which releasably attach to the housings and/or casings of the reels. Moreover, some embodiments provide wire reels with bases that releasably attach to various items such as buckles, saddles, all terrain vehicles (ATV), trucks, other structures and fixtures (such as those in warehouses), etc.

Various embodiments provide wire reels each comprising a cover, a wire hub, and a winding lever. The covers are adapted to removably attach to wire reel casings and to substantially close wire spool apertures of the casings. The wire hubs are adapted to spool wire into/out of the wire spool aperture via wire windows defined by the casings. Moreover, the wire hubs of the current embodiment are coupled to the covers. With regard to the winding levers, they are operably coupled to the covers and are movable between stowed positions and deployed positions. In the stowed positions, the winding levers are substantially adjacent to the covers and are within the perimeters of the covers. In the deployed positions, the winding levers extend beyond the perimeters of the covers.

In some embodiments, the wire reels also comprise the casings. While the wire hubs can have various shapes, they are approximately square in some embodiments. Moreover, if desired, mounting bases or mounting plates can be adapted to accept belts and to removably attach to the casings. Mounting bases of some embodiments can be further adapted to removably attach to the casings via a rotation of the casings. Some covers can be further adapted to removably attach to the casings via a translation.

Furthermore, covers and winding levers of some embodiments define hinges about which the winding levers can pivot. Winding levers can further comprise wind knobs at the distal ends of the winding levers. In some embodiments the covers define knob apertures through which the wind knobs extend when the winding levers are in the stowed position. Various embodiments provide detents which are adapted to retain the winding levers in the stowed position. Moreover, the wire hubs can comprise (or contain) the detents and the detents can engage the winding levers when the winding levers are in the stowed position. Furthermore, when the winding levers are in the deployed positions, the wind knobs can point away from the casings.

In still other embodiments, wire reels comprise casings, covers, and wire hubs. More specifically, the casings of the current embodiment define wire spool apertures and wire windows. The covers releasably attach to the casings and substantially close the wire spool apertures (of the casings) when they are attached to the casings. The wire hubs couple to the covers and are positioned on the covers such that, when the covers releasably attach to the casings, the wire hubs are positioned in the wire spool aperture. Note, also that the wire hubs can spool wire into/out of the wire spool apertures of the current embodiment via the wire windows.

In some embodiments, the covers further comprise winding levers which move between stowed positions and deployed positions. In the stowed positions the winding levers are generally adjacent to the covers and within their perimeters. In the deployed positions, the winding levers extend beyond the perimeters of the covers. Additionally, or in the alternative, some wire reels comprise mounting bases which can accept belts and can removably attach to the casings.

In yet additional embodiments, the covers further comprise winding levers further comprising wind knobs at the distal ends of the winding levers. If desired, the covers define knob apertures through which the wind knobs extend when the winding levers are in the stowed positions. Moreover, wire reels of some embodiments further comprise detents which can retain the winding levers in the stowed position. Those detents can be part of the wire hubs (or can be coupled thereto) and can engage the winding levers when they are in the stowed position.

To the accomplishment of the foregoing and related ends, certain illustrative aspects are described herein in connection with the annexed figures. These aspects are indicative of various non-limiting ways in which the disclosed subject matter may be practiced, all of which are intended to be within the scope of the disclosed subject matter. Other novel and nonobvious features will become apparent from the following detailed disclosure when considered in conjunction with the figures and are also within the scope of the disclosure.

BRIEF DESCRIPTION OF THE FIGURES

The detailed description is described with reference to the accompanying figures. In the figures, the left-most digit(s) of a reference number usually corresponds to the figure in which the reference number first appears. The use of the same reference numbers in different figures usually indicates similar or identical items.

FIG. 6 illustrates a side elevation view of a wire reel.

FIG. 7 illustrates a top plan view of a wire reel.

FIG. 8 illustrates another side elevation view of a wire reel.

FIG. 9 illustrates a cross-sectional view of a wire reel taken along line AA in FIG. 7.

DETAILED DESCRIPTION

This document discloses systems, apparatus, etc. comprising wire reels and, more particularly, reels for use in confined, brushy, and/or other areas for a variety of purposes.

Figure 1:
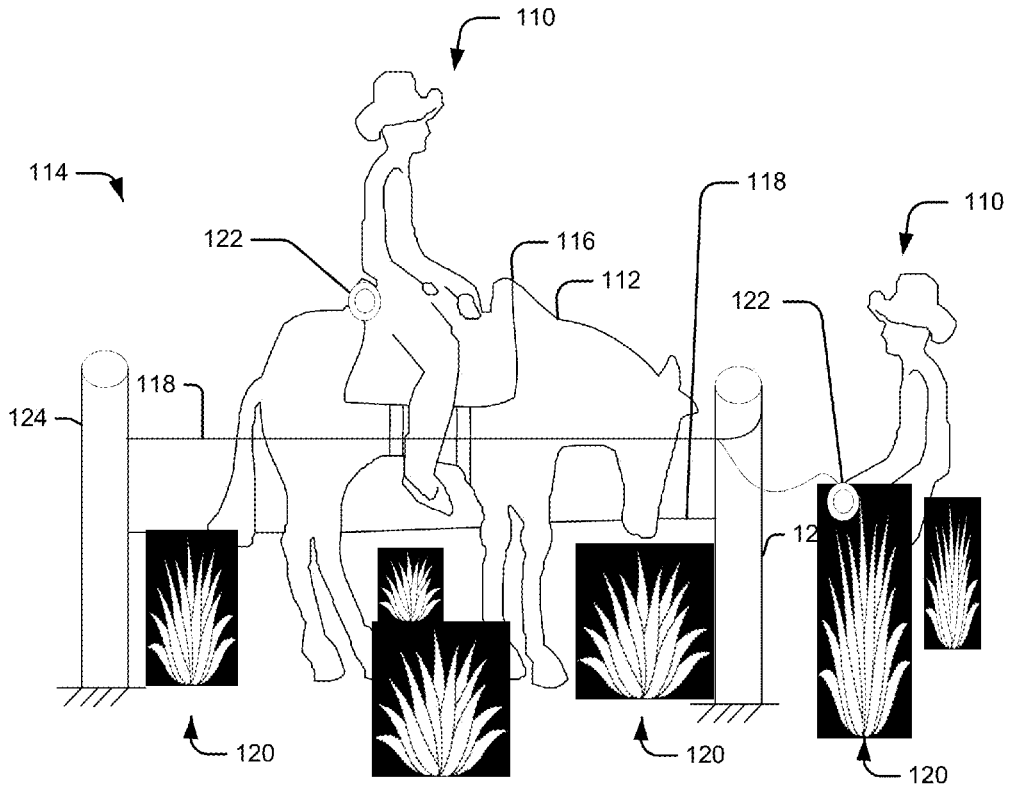
FIG. 1 illustrates a wire reel in use.

FIG. 1 illustrates a wire reel in use. In the scene depicted by FIG. 1 the user is attempting to maintain, repair, or otherwise service a fence. More specifically, FIG. 1 illustrates users 110, a horse 112, an electric fence 114, a saddle 116, one or more wires 118 associated with the fence, various plants (i.e., brush 120), a wire reel 122, and one or more posts 124. One of the user 110 illustrated by FIG. 1 happens to be a ranch owner but could be any type of user with a need or desire to string wire 118 (or other elongated materials) between various locations. For instance, the user 110 could be a residential electrician, an industrial/commercial electrician, some other type of technician, a concrete worker (who might desire to string reinforcing wire through a concrete form), etc. In some scenarios, One of the users 110 is mounted on the horse 112 via the saddle 116 although (one of) the users 110 is on foot, seated, working in or from a vehicle, "cherry picker," etc. In the scenario illustrated by FIG. 1, one user 110 is spooling tie wire out of their wire reel 122 and using it to tie the fence wire 118 to one of the posts 124.

The electric fence 114 illustrated in FIG. 1 includes the posts 124 between which the wires 118 are, or will be, strung and tied to the fence posts. The fence moreover, is illustrative of many places in which various types of elongated materials might be used But as is often the case, in scenarios such as the current one, the fence 114 runs through certain brushy areas. The brush 120 therein can catch or "snag" the wire 118 as the user 110 works with it in those areas. Moreover, the brush 120 can also catch wire reels heretofore available thereby hindering the user 110 in their work and/or other types of activities. In accordance with embodiments, though, user 110 is using wire reels 122 which are configured to minimize, if not eliminate, the chances that the wire reel 122 might catch or snag on the brush 120 and/or other objects in the environment. In addition, or in the alternative, the wire reels 122 can be configured to allow for rapid interchange of the wires 118 which the user 110 might choose to pull.

FIG. 1 also illustrates that the user 110 has selected a particular wire reel 122 for use in the wire-pulling activity. Of course, the term wire pulling also includes activities in which wire is pulled out of the wire reels 122 and those in which it is pulled into the wire reels 122. For the sake of convenience, the term "spool" will be used herein to refer to both types of activities. For the wire spooling activities illustrated by FIG. 1, one user has a wire reel 122 mounted on their saddle 116 while the other user 110 is holding a wire reel 122 and working with it. Moreover, the wire reels 122 of the current embodiment can be conveniently moved between these two locations due to their interchangeable nature. Again, wire reels 122 of the current embodiment are not limited by the uses to which various users 110 might want to put them. Furthermore, the wire spools held within the wire reels 122 of the current embodiment can be conveniently moved between the wire reels 122 because of their interchangeable nature as is further disclosed herein with reference to FIGS. 2-13. More specifically, FIGS. 2-13 illustrate, inter alia, a wire reel 200, a belt 204, a casing 206, a mounting base 208, a cover 210, a wire spool 212, a spool release pin 218, a winding lever 228, an axle 230, rivets 240, and belt slots 242 and mounting holes 244.

Figure 2:
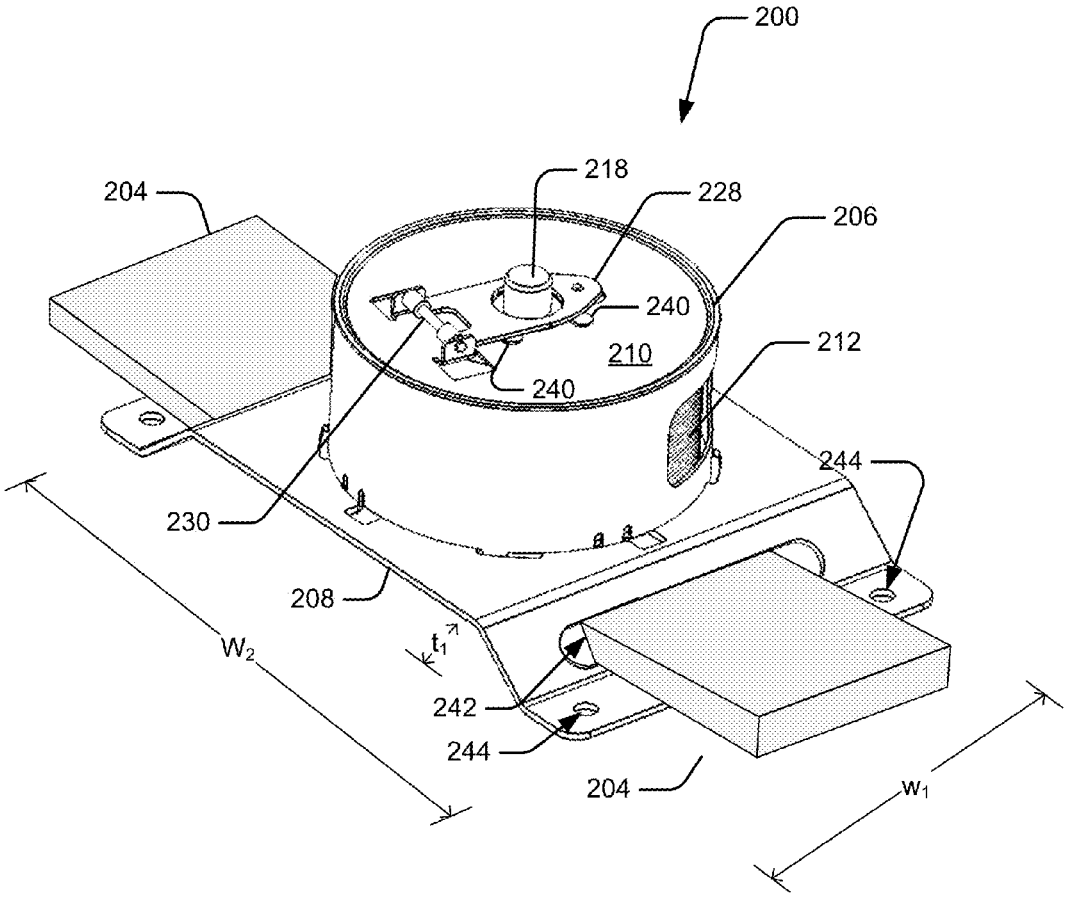
FIG. 2 illustrates a wire reel on a mounting plate with a winding lever in a stowed position.

FIG. 2 illustrates a wire reel on a mounting base (mounting plate, buckle, etc.) with the winding lever in a stowed position. The wire reel 200 of the current embodiment includes the casing 206 and the mounting base 208 which are releasably attached to one another. Moreover, the casing 206 contains (when desired) the wire spool 212 while the mounting base 208 allow attachment of the wire reel 200 to some object (such as a user's belt 204). That attachment can be by way of guiding the belt 204 through the belt slots 242 and/or by using the mounting holes 244 to secure the mounting base 208 to the belt 204. These mounting holes 244 can accept rivets, wires, etc. for coupling the wire reel 200 to objects such as saddles, all terrain vehicles (ATVs), trucks, etc.

When desired, a latch (not shown in FIG. 2) can be actuated (for instance, pushed, depressed, etc.) to release the wire reel 200 (or casing 206) from the mounting base 208. More specifically, actuation of the latch can release the casing 206 from the mounting base 208 freeing it to rotate relative to the mounting base 208 to disengage slots (also not shown in FIG. 2) that work in conjunction with the latch to hold the casing 206 in fixed relationship with the mounting base 208. The user can then twist the casing 206 to free it from those slots and then remove it from the mounting base 208. Attachment of the casing 206 to the mounting base 208 can generally occur in reverse order. Additionally, in some embodiments, the spool release pin 218 can be actuated to release the cover 210 from the casing 206. As is disclosed further herein, when not actuated, the spool release pin 218 works in conjunction with other aspects of the wire reel 200 to operationally couple the cover 210 (and wire spool 212) to the casing 206.

While the cover 210 and wire spool 212 are held in the casing 206, the user can use the winding lever 228 to spool wire into and/or out of the wire reel 200. But, wire can be dispensed without using the winding lever 228 by pulling it from the wire reel 200. Of course, FIG. 2 illustrates the winding lever 228 in a stowed position in which it lies against the cover 210 and within the perimeter of the casing 206 and/or cover 210. Indeed, the winding lever 228 lies generally flush against the cover 210 in the stowed position thereby minimizing chances that it might snag, hang up on, catch, etc. objects in its environment as the wire reel 200 is moved about. The overall low aspect ratio or "thin" or "flat" configuration of the winding lever 228 also helps in minimizing such opportunities for snags.

FIG. 2 also illustrates a central axis (the z axis) which could point in any direction. For instance, when the mounting base is attached to a user's belt the z axis would typically point to/away from the body of the user whereas if the wire reel 200 were laying on a horizontal surface the z-axis would point vertically to/from the horizontal surface.

The mounting base 208 includes the belt slots 242 one on either side of the mounting base 208. When a user wants to fasten wire reels 200 to their belt the user can thread their belt 204 through the belt slots 242 as they put their belt on. In the alternative, or in addition, the user can align the mounting base 208 with their belt 204 and insert selected fasteners through the mounting holes 244. Provided that the belt can accept or at least cooperate with the fasteners, the mounting holes 244 therefore allow the user to attach the mounting base 208 to user belts. In some cases, rivets can be used for the fasteners however a wide variety of other fasteners (to extensive to list conveniently here) could be used.

Note also that the mounting base 208 is shaped and dimensioned to minimize the possibility that it might snag on brush or other objects in its environment. More specifically, the mounting base 208 has an overall thickness t1, a width w1 (in one particular direction) and another width w2 (in the remaining orthogonal direction) which define various aspect ratios. The thickness t1 and widths w1 and w2 can be selected relative to one another such that the aspect rations t1/w1 and t1/w2 are small fractions of 1 so as to minimize the area presented to potential snags as the user moves through brush (and other snag-prone environments). With the user's belt threaded through the belt slots 242 (thereby filling the gap created by the thickness t1, the mounting base 208 therefore presents relatively little in the way of protrusions, voids, or other structures which could snag objects in the environment.

Figure 3:
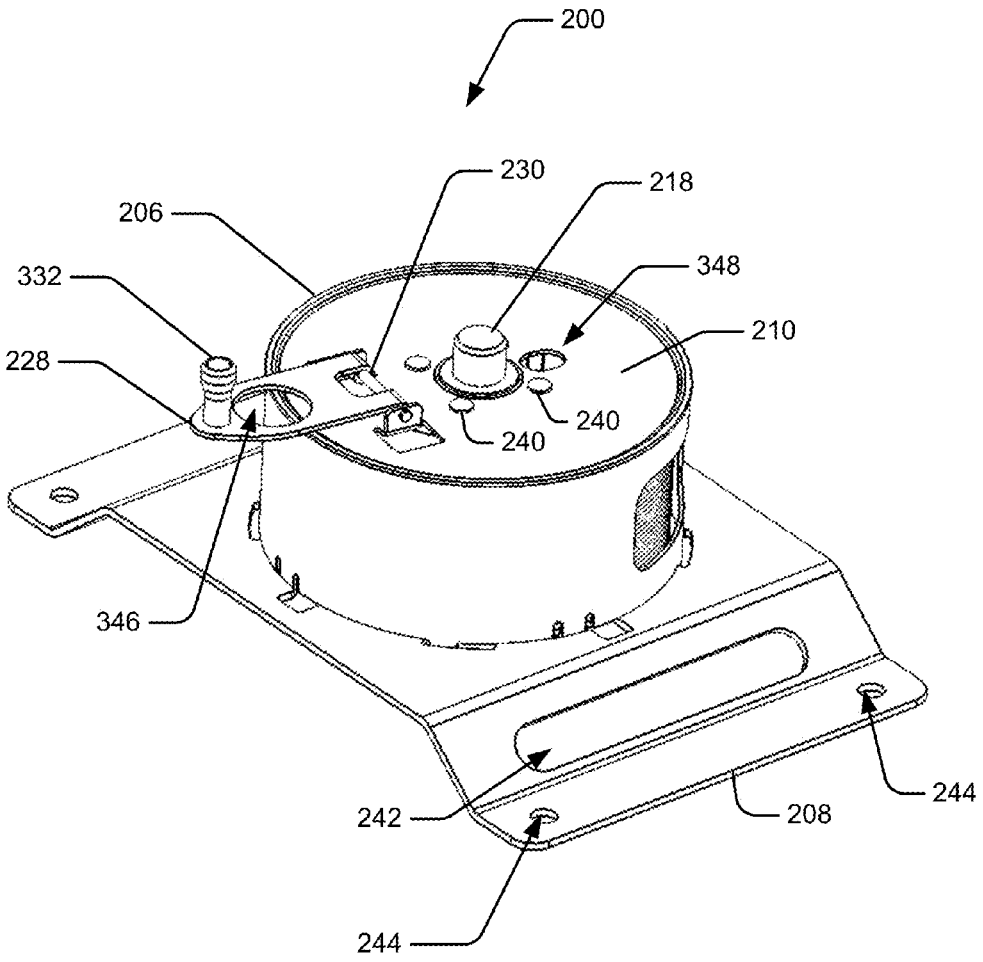
FIG. 3 illustrates a wire reel with a winding lever in a deployed position.

In contrast to FIG. 2, FIG. 3 illustrates a wire reel with the winding lever in a deployed position. In the deployed position, the winding lever 228 extends beyond the perimeter of the casing 206 and/or cover 210. Thus, it provides a moment arm to leverage the force of the users motions in winding the winding lever 228 to spool wire. The wind knobs 332 can be at the distal end of the winding levers 228 to further aid the user in spooling wire. Thus, to spool wire into/from the wire reel 200, the user can move the winding lever 228 from the stowed position (see FIG. 2) to the deployed position (see FIG. 3) and move the winding lever 228 in a desired direction corresponding to whether the user wants to spool wire into or out of the wire reel 200.

Note, moreover, that the winding lever 228 defines a pin aperture 346 dimensioned and configured to accept the proximal end of the spool release pin 218. Moreover, the cover 210 defines a knob aperture 348 dimensioned and configured to accept the winding knob 332. Thus, when the winding lever 228 moves from its deployed position to its stowed position, the pin aperture 346 accepts the spool release pin 218 while the knob aperture 348 accepts the winding knob 332. As a result, the winding lever 228 of the current embodiment can lie generally flush against the cover 210 thereby offering little on which objects in the environment can snag.

Figure 4:
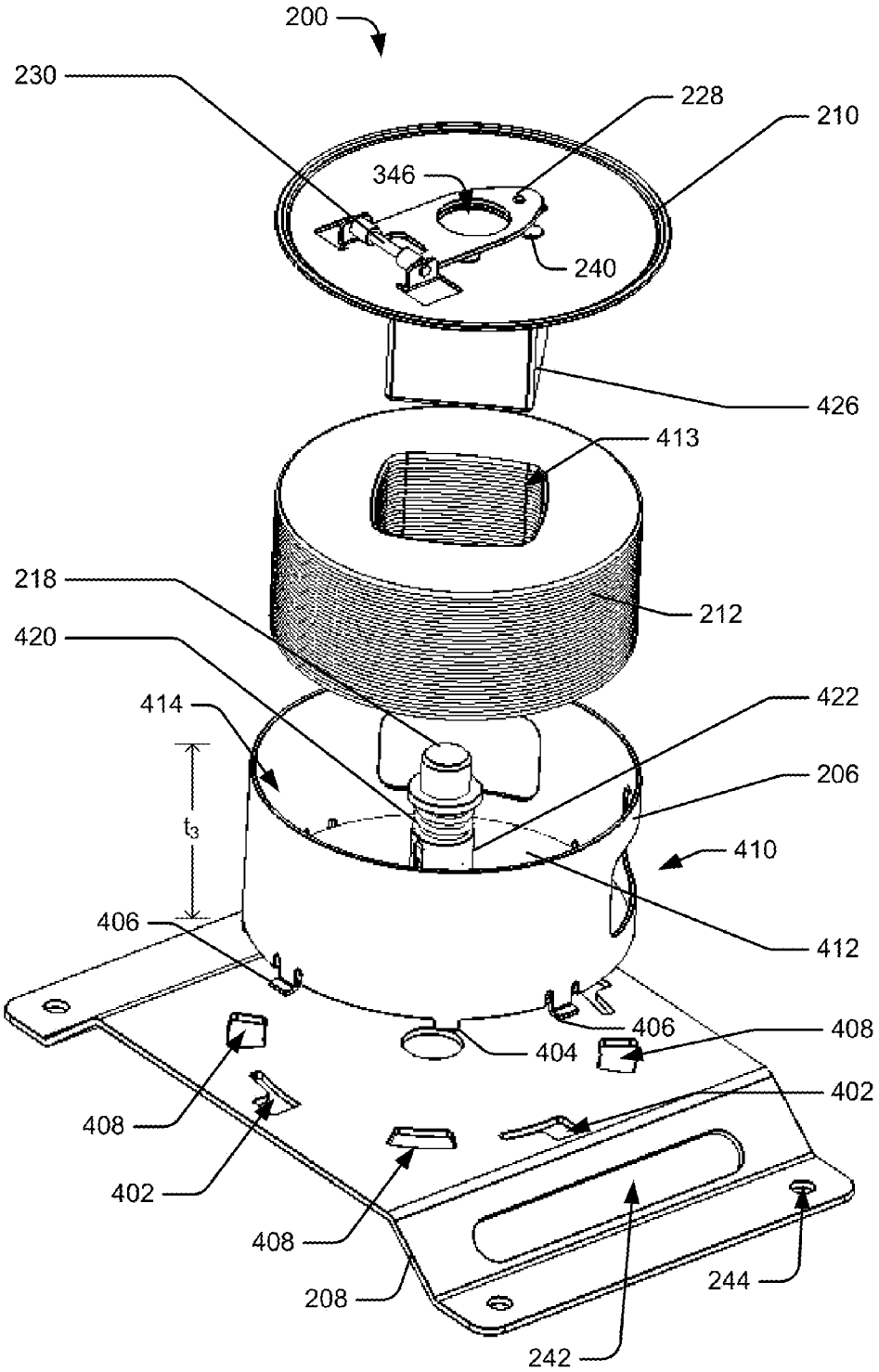
FIG. 4 illustrates a partially disassembled wire reel.

FIG. 4 illustrates a partially disassembled wire reel. More specifically, FIG. 4 illustrates L-shaped slots 402, straight tabs 404, L-shaped tabs 406, alignment slots 408, wire windows 410, casing base 412, spool aperture 414, spring 420, casing hub 422, and winding hub 426. The L-shaped slots 402 and a latch aperture (not shown) defined by the mounting base 208 cooperate (respectively) with L-shaped tabs 406 on the casing 206 and a latch (not shown) to releasably attach the wire reel 200 (or, rather, the casing 206) to the mounting base 208. Accordingly, the L-shaped tabs 406 of the casing 206 extend away from one end of the casing 206 in a direction parallel to the z axis a distance sufficient to protrude through the L-shaped slots 402 of the mounting base 208. The base of the L-shaped tabs 406 can thus engage the body of the mounting base 208 (in the vicinity of the L-shaped slots 402) thereby securing the mounting base 208 and casing 206 against one another. However the base of the L-shaped slot 402 can be shaped and dimensioned to allow the base of the L-shaped tabs 406 to pass there though while the legs of both the slots and the tabs can allow rotational motion between the mounting base 208 and casing 206 even while they are mated.

As a result, a user can bring the casing 206 into proximity with the mounting base 208 with the L-shaped tabs 406 and L-shaped slots 402 in approximate alignment. The user can also, if desired, mate the casing 206 with the mounting base 208 such that the L-shaped tabs 406 pass through the L-shaped slots 402. The user can also twist the casing 206 relatively to the mounting base 208 to cause the bases of the L-shaped tabs 406 to engage the body of the mounting base 208. As a result, the casing 206 and the mounting base 208 can be operationally coupled to one another. Moreover, the user can reverse the process to detach and/or release the casing 206 from the mounting base 208. In some embodiments, as is disclosed further herein, a latch and a latch aperture of the mounting base 208 can be configured to latch the casing 206 and the mounting base 208 together.

With continued reference to FIG. 4, the casing 206 includes other aspects of wire reels 200 of the current embodiment. For instance, the straight tabs 404 on the casing 206 and the alignment slots 408 (defined by the mounting base 208) can be configured such that they facilitate aligning the casing 206 and the mounting base 208 before the L-shaped tabs 406 engage the L-shaped slots 402. Thus, these features can facilitate the rapid and/or convenient attachment of the casing 206 to the mounting base 208.

Moreover, FIG. 4 illustrates that the casing 206 can define one or more wire windows 410 through which wire can be spooled to/from the wire reel 200. These wire windows 410 can span a significant portion of the overall thickness t2 of the casing 206. Moreover, the specific portions of the casing thickness t2 which they span can be chosen in conjunction with the types of wire and sizes of the wire spools to allow the wire to spool freely across the face of these wire spools 212. Likewise, the arc through which they stretch around the casing 206 can be chosen to allow free spooling of the wire to/from the casing 206. In wire reels 200 of some embodiments the wire windows 410 can (each) stretch across about ⅕ of the circumference of the wire reel 200. If desired, the resulting ribs of material surrounding the wire windows 410 can be thickened to reinforce the casing 206 and/or improve its wear characteristics. It is believed moreover, that rounding these reinforcing ribs can reduce binding between the wire and the casing 206.

The casing 206 can also include (or couple with) a casing base 412 to close the spool aperture 414 defined by the casing 206. In this way, wire in the casing 206 can abut the casing base 412 which can be coupled to and turn with the casing 206. Thus, the casing base 412 reduces friction between the wire and the wire reel 200. The casing base 412 can also prevent the wire from catching on the various slots, apertures, etc. defined by the mounting base 208 and/or otherwise internally binding/snagging. In some embodiments, though, the casing base 412 floats with respect to the casing 206 at the wire windows 410.

With further reference to FIG. 4, a casing hub 422 about which wire reels 200 of the current embodiment rotate is illustrated. The casing hub 422 is positioned centrally in the casing 206 and is coupled therewith to allow the wire reel 200 (or certain components thereof) to rotate about it. Additionally, or in the alternative, the casing hub 422 can operate to aid in releasably attaching the casing 206 to the mounting base 208. Indeed the casing hub 422 contains and/or cooperates with the spool release pin 218 to attach/detach the casing 206 and the mounting base 208. In some embodiments, the spring 420 biases the spool release pin 218 toward either a position in which it secures the casing 206 and mounting base 208 to one another or a position in which it releases them from one another.

FIG. 4 also illustrates that spools of wire can fit within casing 206. Indeed the casing 206 can define the spool aperture 414. While FIG. 4 illustrates one wire spool 212 as not including a core about which the wire is wound, the scope of the current disclosure includes wire spools 212 with such cores. Whether the wire spools 212 include cores or not, they typically define a central aperture 213 that is somewhat circular, oblong, or a blend thereof. Of course, wire spools 212 tend to have a generally circular shape as illustrated by FIG. 4 due to the winding of the wire.

Wire reels 200 of the current embodiment include winding hub 426 which can have square, oblong, circular, etc. cross-section and can be sized to correspond to the spool aperture 424 of the wire spool 212. It can engage the wire spool 212 and provide for the operative coupling of the wire therein to the wire reel 200. The inventors have found, that in some scenarios, square, oblong, and similarly shaped winding hubs 426 allow for the uptake and/or retention of wire thereon without the need for securing the inner end of the wire thereto. But a hole can be provided in the winding hub 426 into which one end of a wire can be inserted to "start" a spool of wire and/or retain the wire on the winding hub 426. Doing so can prevent the wire slipping relative to the wire hub 426, Moreover, in some embodiments, the winding hub 426 couples to the cover 210. As a result, the cover 210, the winding hub 426, and the wire spool 212 can be used as an operative unit. Indeed, covers 210 can be pre-fit with wire spools 212 and interchanged as users might desire. As is further disclosed herein, the spool release pin 218 of embodiments facilitates the operative coupling/decoupling of wire spools 212 to/from the wire reel 200 (and thus their interchangeability with one another).

FIG. 4 also illustrates that the casing 206 is generally circular when viewed from along the z-axis. It is believed that this shape helps avoid snags on the wire reel 200. Also, the casing 206 can be sized to hold spools of wire of certain sizes. More specifically, casings of various embodiments have diameters of approximately 4 inches and can have depths (or thicknesses) of approximately 1¾ inches to approximately 2 inches. Thus, such wire reels 200 can hold approximately 100 to 200 feet of coiled 14 or 16 gauge wire and/or similar elongated materials. While the casings 206, covers 210, etc. can be made from any suitable material (for instance, stainless steel) wire reels 200 of embodiments are made from high density polyethylene (HDP) plastic. At this juncture, it might be helpful to consider some internal features of wire reels 200 of some embodiments.

Figure 5:
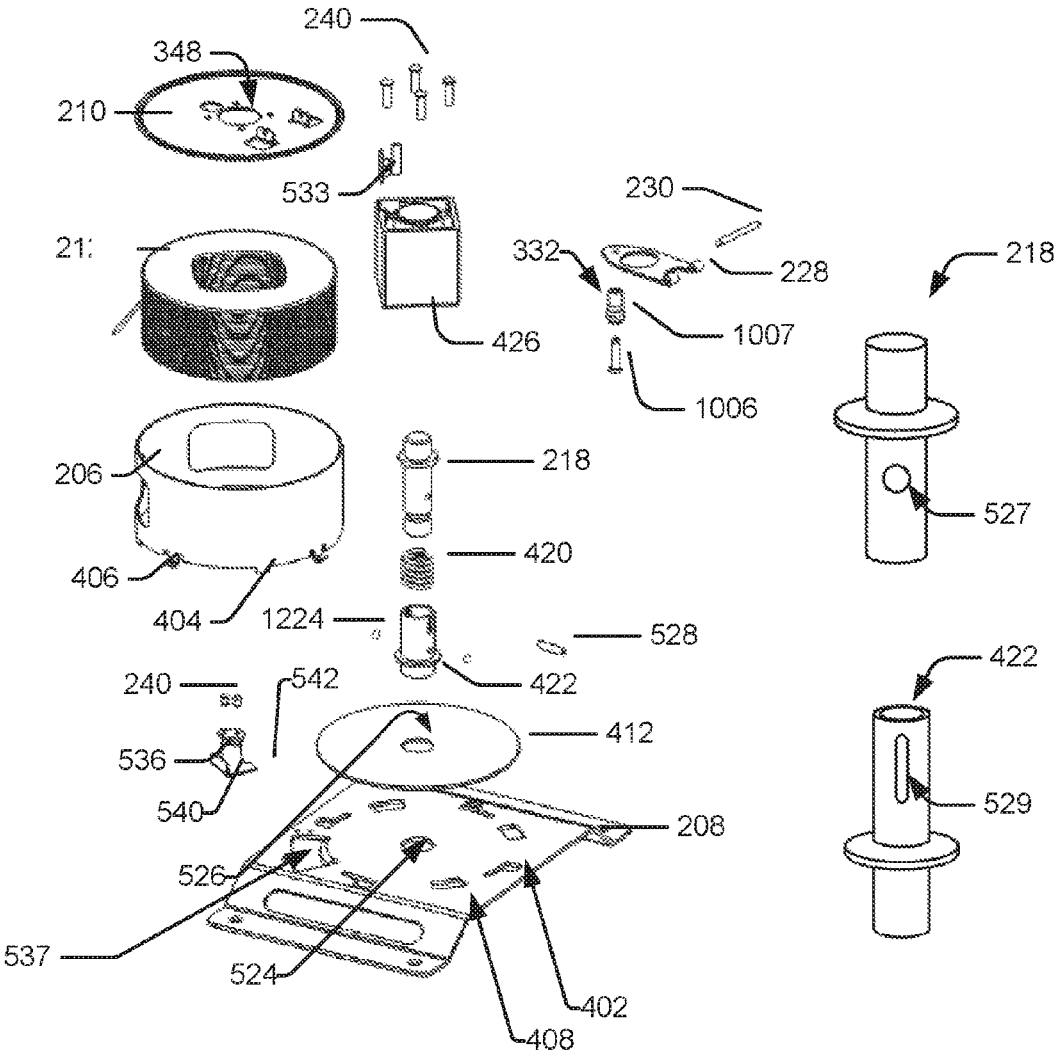
FIG. 5 illustrates a disassembled wire reel.

FIG. 5 illustrates a disassembled wire reel. More specifically, FIG. 5 illustrates hub apertures 524 and 526, pin hole 527, rolling pin 528, slots 529, lever detent 533, latch 536, latch aperture 537, latch actuator 540, and lip 542. FIG. 5 also illustrates the cover 210, the wire spool 212, and the casing 206 being in generally concentric relationship with one another. Moreover, these components can also be in concentric relationship with the winding hub 426, the casing base 412, and the mounting base 208 (or the hub apertures 524 and 526). Furthermore, the casing hub 422 can be in concentric relationship with the foregoing components (along with the wire spool 212). Of course, for those components that have some fixed relationship with one another, rivets (or other fasteners, welds, brazes, etc.) can provide the desired coupling.

In addition to the foregoing features, FIG. 5 further illustrates the latch 536 and the latch aperture 537. The shape of the latch aperture 537 corresponds to the shape of the latch 536 such that the latch 536 (or a portion thereof) can pass freely through the latch aperture 537. Moreover, the mounting base 208 defines the lip 542 whereas the latch 536 includes a slight protrusion or the latch actuator 540 which can extend through the latch aperture 537 despite the position of the latch 536 itself. In other words, whether the latch 536 is actuated (pushed/pulled through the latch aperture 537) or un-actuated (left more or less in a default position in which it lies generally flush with the body of the mounting base 208), the latch actuator 540 can be accessed by a user from the side of the mounting base 208 facing the casing 206. Moreover, the latch 536 and the lip 542 can be configured such that when the latch 536 is in its un-actuated position, it abuts the lip 542 thereby preventing relative rotation between the casing 206 and the mounting base 208. In contrast, when the latch 536 is in its actuated position, the latch 536 can clear the lip 542 thereby allowing relative rotation between the casing 206 and the mounting base 208. Of course latches 536 of other configurations can be used with wire reels of various embodiments. Nonetheless, the latch 536 can lock the casing 206 and mounting base 208 in a fixed relationship with each other when in its un-actuated position.

FIG. 5 also illustrates hub apertures 524 and 526 in respectively the mounting base 208 and the casing base 412. As is further disclosed herein, the apertures 524 and 526 allow the casing hub 422 to rest therein and facilitate the relative rotation of the wire reel 200 and the mounting base 208. Moreover, since the casing base 412 defines the hub aperture 526, the casing base 412 of the current embodiment can rotate relative to the mounting base 208 with the wire reel 200.

Figure 10:
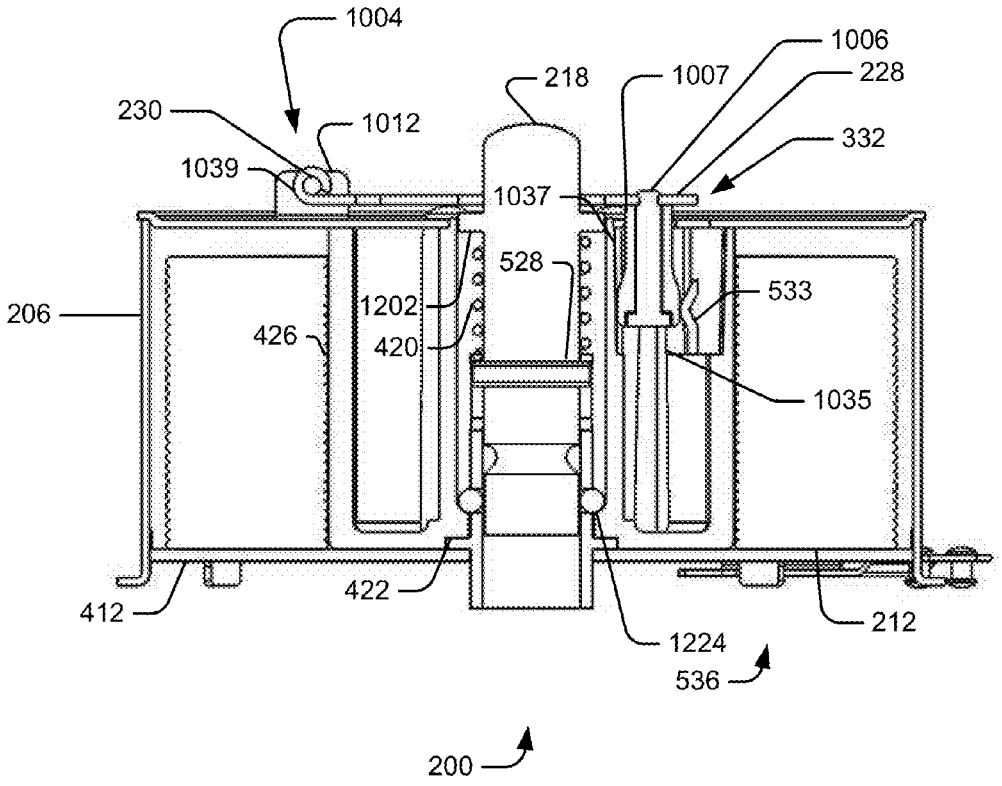
FIG. 10 illustrates a cross-sectional view of a wire reel with a winding lever in a stowed position.
Figure 11:
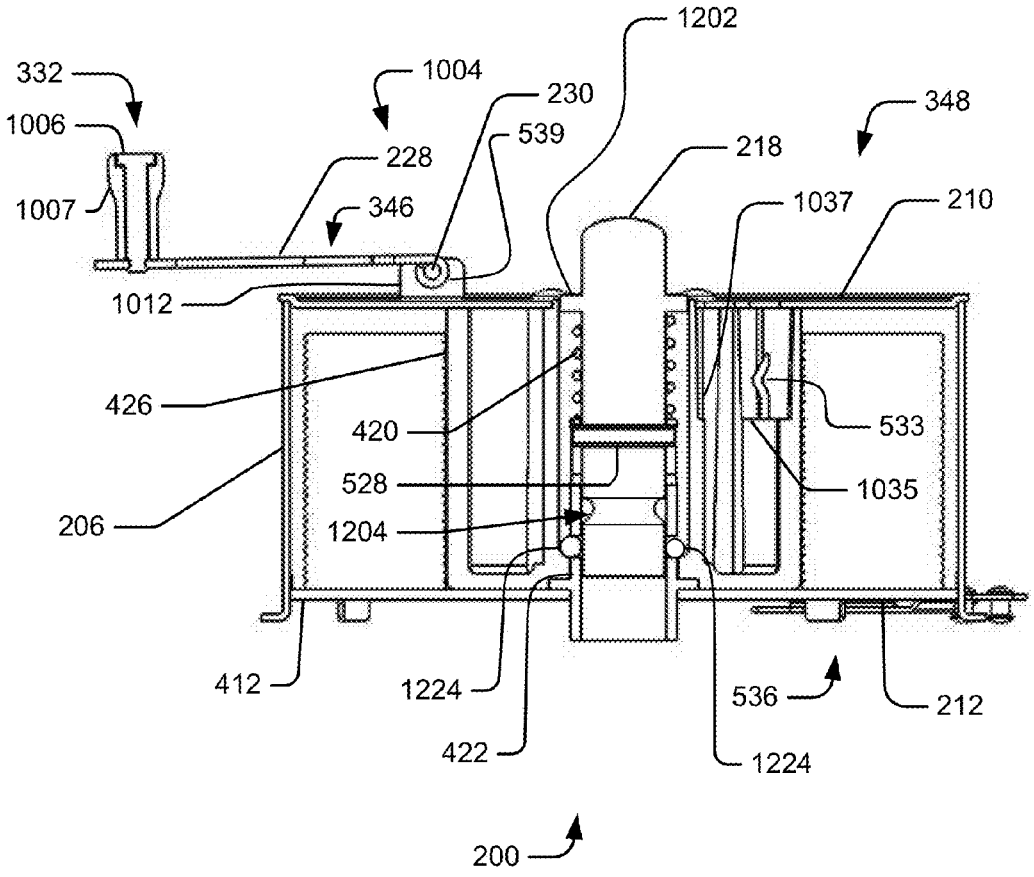
FIG. 11 illustrates a cross-sectional view of a wire reel with a winding lever in a deployed position.
Figure 12:
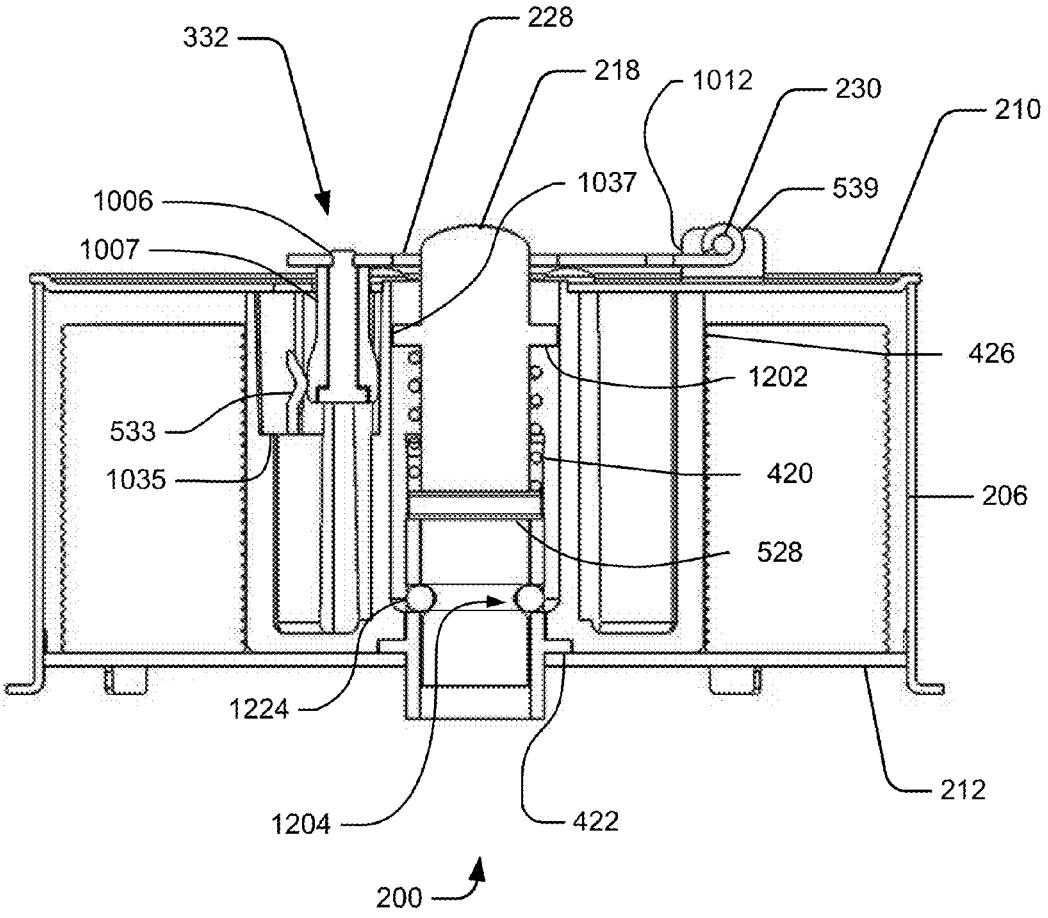
FIG. 12 illustrates a cross-sectional view of a wire reel with a spool release pin in an actuated position.

FIGS. 6-12 provide further views of wire reels of embodiments. For instance, FIG. 6 illustrates a side elevation view of a wire reel whereas FIG. 7 illustrates a top plan view of a wire reel. FIG. 8 illustrates another side elevation view of a wire reel and FIG. 9 illustrates a cross-sectional view of a wire reel taken along line AA in FIG. 7. FIG. 10 illustrates a cross-sectional view of a wire reel with a winding lever in a stowed position. FIG. 11 illustrates a cross-sectional view of a wire reel with a winding lever in a deployed position. FIG. 12 illustrates a cross-sectional view of a wire reel with a spool release pin in an actuated position. Thus, a comparison of FIGS. 6-12 (and more particularly FIGS. 10-12) reveals various features of wire reels 200 of the various embodiments.

For instance, a comparison of FIGS. 10 and 11 reveals differences between wire reels 200 of embodiments with their winding levers 228 in, respectively, their stowed and deployed positions. In the deployed position, the winding lever 228 (and more particularly the winding knob 332 lies inside of the perimeter of the casing 206 (the cover 210, etc.) as indicated by a radius r1 of the casing 206. Moreover, in the stowed position (FIG. 10) the winding lever 228 abuts the cover 210 and more or less lies flat there against minimizing opportunities for objects in the environment to snag the winding lever 228. One feature that facilities the compactness of the wire reel 200 of the current embodiment is the hook 1039 of the winding lever wrapping around the axle 230 from below in the stowed position.

Furthermore, in the stowed position the wire reel 200 substantially contains the winding knob 332 and therefore prevents it from snagging on objects in the environment. More specifically, in the stowed position illustrated by FIG. 10, the winding knob 332 resides within the knob aperture 348 defined by the winding hub 426. In the current embodiment, the lever detent 533 also resides in the knob aperture 348 supported by an inner lip 1035 of the winding hub 426. Additionally, the winding hub 426 can comprise a tapered portion 1037 which tapers in such a way as to bias the winding knob 332 against the lever detent 533. Thus, when in the stowed position, the tapered portion 1037 and the lever detent 533 secure the winding knob 332 in the winding hub 426.

With continuing reference to FIGS. 10 and 11, the winding lever 228 of embodiments can rotate about axle 230 which helps define the hinge 1004. Furthermore, in some embodiments, the hinge 1004 between the cover 210 and the winding lever 228 can be positioned to be generally adjacent to one of the walls of the oblong winding hub 426. A portion of the hinge 1004 can be formed from the body of the cover 210 by (for instance) bending a pair of tabs from the cover 210 to form the knuckles 1012 of the hinge 1004.

That hinge 1004 can be positioned to one side of the centrally located spool release pin 218 with the lever detent 533 being located on the opposite side thereof. Thus, the winding lever 228 can rotate such that the pin aperture 346 (or its walls) slidably engages the exposed portion of the spring release pin 218. In some embodiments, though, the pin aperture 346 of the winding lever 228 allows for a clearance fit between the winding lever 228 and the spool release pin 218. Note also that the winding knob 332 can comprise the rivet 1006 (or other fastener) to couple it to the winding lever 228 and a knob body 1007. The latter being shaped and dimensioned to interact with the lever detent 533 (and/or tapered portion 1037 if the winding hub 426) thereby aiding in the retention of the winding knob 332 (and winding lever 228) by the lever detent 533. In some cases, the knob body 1007 has a diameter of about ⅜ of an inch to facilitate a user griping it and rotating the wire spool 212 with it.

At this juncture it might be helpful to discuss some aspects related to how spool release pins 218 of embodiments operate to provide for the release of the wire spool 212 from the casing 206 and the operative coupling and/or attachment there between. To that end, a comparison of FIGS. 10 and 12 reveals features related to releasably (and/or operatively) attaching the wire spool 212 to the casing 206 of the current embodiment. More specifically, FIG. 10 illustrates the spool release pin 218 in an un-actuated position whereas FIG. 12 illustrates it in an actuated position as the difference between the heights h1 and h2 (of the proximal end of the spool release pin 218) above the cover 210 indicate. Of course the terms "height" and "above" here are used merely for convenience and, more generally, it can be said that the proximal end of the spool release pin 218 is spaced apart from the cover 210 or some other datum) by different distances when in its two positions. Moreover, in some embodiments the un-actuated position is the position wherein the proximal end of the spool release pin 218 is closer to the cover 210 and the actuated position is the position wherein it is farther from the cover 210. Further still, while the spool release pin 218 can actuate a ball/socket quick disconnect between the wire reel 212 and the casing 206, other types of releasable attachment mechanisms (such as bayonet attachment mechanisms) can be used for such purposes.

Starting from the proximal end of the spool release pin 218 and working toward the distal end, the spool release pin 218 and the wire reel 200 comprise features related to releasably attaching the wire spool 212 and the casing 206. For instance, the spool release pin 218 of the current embodiment defines a flange 1202. The flange 1202 serves to close the pin aperture 346 and serves to compress the spring 420. Accordingly, the spring 420 can bias the spool release pin 218 toward the un-actuated position. But, even so, the flange 1202, the body of the spool release pin 218, and the inner wall of the winding hub 426 can contain the spring 420 during operation of the spool release pin 218 (as well as at other times). As such the flange 1202 can span the distance between the inner walls of the winding hub 426 thereby providing a sliding fit between itself and those inner walls.

With continuing reference to FIGS. 10 and 12, the spring 420 can be concentrically mounted around the spool release pin 218. But, it can be placed in other locations if desired and need not be a compression spring. For instance, it could be in tension or it could comprise some compressible material such as an elastomer. Moreover, the proximal end of the casing hub 422 can aid in confining and compressing the spring 420 (at its distal end) as illustrated in FIGS. 10 and 12.

Moreover, one end of the casing hub 422, in the current embodiment, defines a pair of recesses 1204 into which the ball bearings 1224 can fit. These recesses 1204, in conjunction with the ball bearings 1224, allow the cover 210 and wire spool 212 to releasably attach to the casing 206. More specifically, when the spool release pin 218 is in its un-actuated position, the recesses 1204 are spaced apart from the ball bearings 1224 such that the ball bearings 1224 engage both the casing hub 422 and the winding hub 426. See FIG. 10. Thus, the ball bearings 1224 hold the hub 422 and the winding hub 426 in fixed (translational) relationship to one another while allowing these objects to rotate relative to each other about the z axis. Moreover, it has been found that the ball bearings 1224 can hold the casing hub 422 and the winding hub 426 in fixed relationship to each other such that the winding hub 426 can not translate toward the proximal end of the spool release pin 218 and thence out of engagement with the wire reel 200 in general. In the meantime, the casing base 412 and/or mounting base 208 (or other structure on which the wire reel 200 might be mounted) prevents relative translational movement between the casing hub 422 and the winding hub 426 in the other direction.

However, when the spool release pin 218 is in its actuated position (FIG. 12) the recesses 1204 are positioned to accept the ball bearings 1224 The ball bearings 1224 and recesses 1204 of the current embodiment are shaped such that it requires some force on the spool release pin 218 to overcome the spring 420 and to move the ball bearings 1224 from the recesses 1224. Indeed, the ball bearings 1224 of the current embodiment are in the recesses 1204, they only engage the casing hub 422 leaving the winding hub 426 free to translate toward (and beyond) the proximal end of the spool release pin 218. Since the cover 210 is coupled to the winding hub 426 in some embodiments, therefore the cover 210 and the winding hub 426 (and the wire spool 212 on it) can be removed and/or replaced as a unit.

It might also be worth noting that in its un-actuated position as illustrated by FIG. 10, the spool release pin 218 resides in a position in which the flange 1202 is approximately adjacent to the cover 210. Meanwhile, in the actuated position as illustrated by FIG. 12, the flange 1202 is spaced apart from the cover 210. Likewise, the distal end of the spool release pin 218 translates between a position spaced apart from the casing base 412 (within casing 206) and a position extending somewhat from the casing 206 (and casing base 412) though still being within the casing hub 422. Note that the casing hub 422 of the current embodiment extends from the casing base 412 to house the spool release pin 218 in this position. The extent to which the casing hub 422 extends from the casing base 412 and the heights h1 and h2 (between the actuated and un-actuated positions) can be selected together so that the protrusion fits within the void behind the mounting base 208. Thus, the spool release pin 218 (whether actuated or not) presents little in the way of protrusions that might snag external objects.

FIGS. 10 and 12 also illustrate how the rolling pin 528, casing hub 422, and spool release pin 218 cooperate to releasably attach/detach the wire spool 212 from the wire reel 200. More specifically, FIGS. 10-12 (and FIG. 5) illustrate that the spool release pin 218 defines a pinhole 527 through which the rolling pin 528 can be inserted. Meanwhile, the casing hub 422 defines a pair of slots 529 via which the rolling pin 528 can engage the casing hub 422.

In general, the rolling pin 528 causes the spool release pin 218 and casing hub 422 to rotate together. It also allows the spool release pin 218 to translate relative to the casing hub 422 between the actuated and un-actuated positions via its sliding contact with the casing hub 422 in the slots 529. Thus, the rolling pin 528 operably couples the spool release pin 218 and the casing hub 422.

Figure 13:
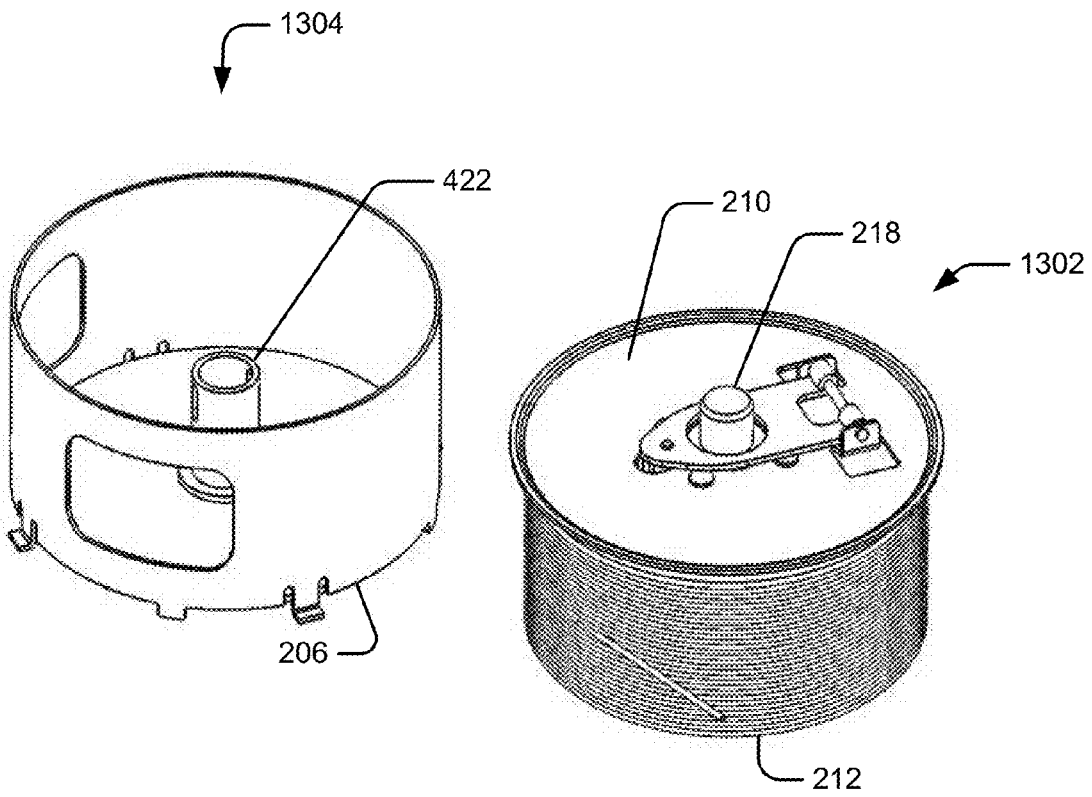
FIG. 13 illustrates a wire reel with its spool removed from the casing.

FIG. 13 illustrates a wire spool detached from a wire reel. More specifically, FIG. 13 shows the cover 210, wire spool 212, spool release pin 218, and spring 420 (not visible), and winding hub 426 (not visible) coupled together as one assembly 1302. FIG. 13 also illustrates the mounting base-casing 206, casing base 412, and casing hub 422 operatively coupled together as another assembly 1304.

These assemblies 1302 and 1304 can be re-attached to one another via the spool release pin 218 and components related thereto. For instance, the spool assembly 1304 can be brought into the proximity of the casing assembly 1302 with the spool release pin 218 and pin aperture 1306 in rough alignment with one another. The spool assembly 1304 can be translated toward the casing assembly 1302 so that the spool release pin 218 translates into the casing hub 422. The user can release the spool release pin 218 allowing the spring 420 to urge it into its un-actuated position and driving the ball bearings 1224 to move out of the recesses 1204. As a result, the ball bearings 1224 engage the casing hub 422 and the winding hub 426 thereby operatively securing the two assemblies 1302 and 1304 together while leaving them free to rotate relative to one another about the hub 422 and spool release pin 218 (or spindle of the wire reel 200).

When desired, the user can pivot the winding lever 228 about the hinge 1004 from its stowed position into its deployed position. Of course, while it had been in the stowed position the lever detent 533 was retaining it in the stowed position whereas as the user moves it, the lever detent 533 releases the winding knob 232. As the user continues moving the winding lever 228 it eventually extends beyond the perimeter of the casing 206.

In that position, the winding lever 228 enjoys a certain mechanical advantage over frictional forces that might be present as well as against the weight/inertia of the wire to be pulled (and/or other forces). Thus, the user can wind the winding lever 228 using the winding knob 232 to spool wire into or out of the wire reel 200. As the user does so, the body of the winding lever 228 can rotate about the rivet 1006 thereby facilitating the spooling of the wire while allowing the user to grip the winding knob 232.

Figure 14:
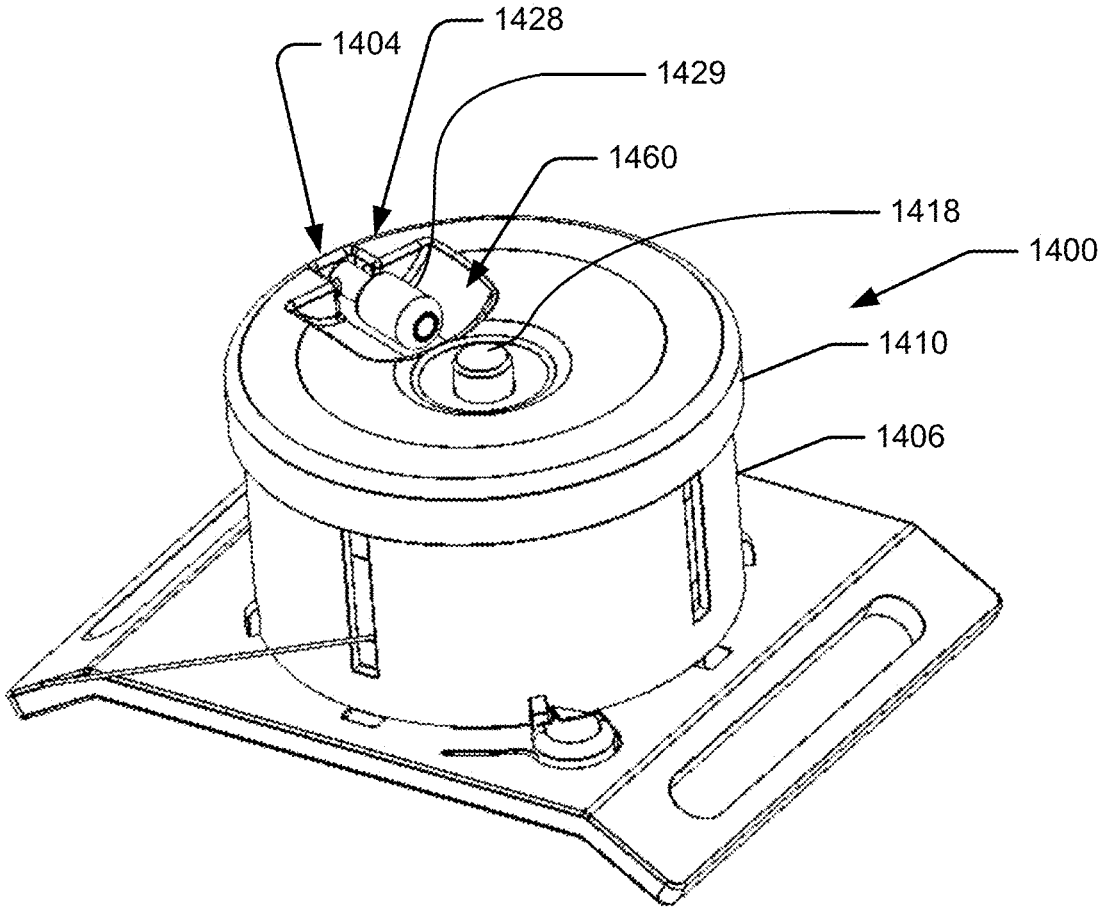
FIG. 14 illustrates a perspective view of another wire reel.

FIG. 14 illustrates a perspective view of another wire reel. Among other features, FIG. 14 illustrates that the wire reel 1400 comprises a hinge 1404, a casing 1406, a cover or cap 1410, spool release pin 1418, a winding knob 1428, and a knob cavity 1460. In the current embodiment, the winding knob 1428 pivots about the hinge 1404 between deployed and stowed positions and in the stowed position it resides recessed in the knob cavity 1460. In this manner (and perhaps others) the winding knob 1428 is flush with the proximal side of the cover 1410 and presents little that might snag or catch on objects in the environment. Note, however, that when the winding knob 1428 is in its deployed position at least a widened portion 1429 of the wind knob extends at least partially beyond the perimeter of the casing 1406 and/or cap 1410.

Figure 15:
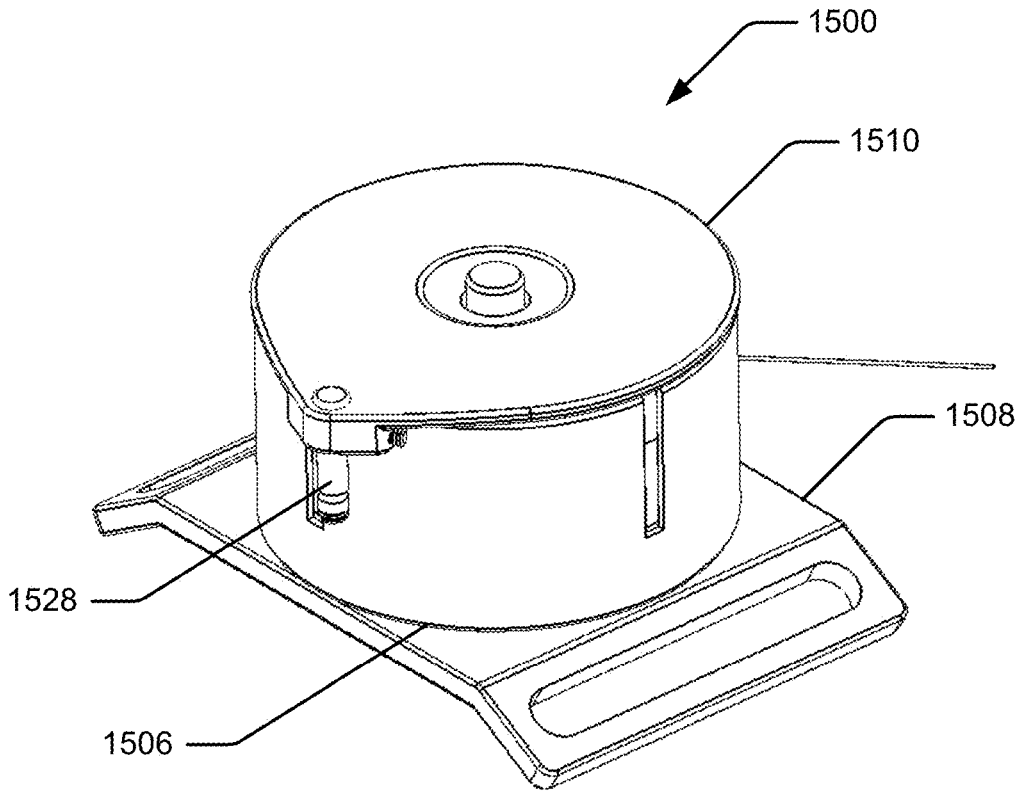
FIG. 15 illustrates a perspective view of yet another wire reel.

FIG. 15 illustrates a perspective view of yet another wire reel. In the current embodiment, the wind knob 1528 (or pin) of the wire reel 1500 translates between its stowed position and its deployed position. More specifically, in it's stowed position the wind knob 1528 resides with its proximal end flush with the proximal surface of the cover 1510 and its distal end between the proximal end of the cover 1510 and the mounting base 1508. Thus, the casing 1506 tends to shield it from snagging objects in the environment.

Conclusion

Although the subject matter has been disclosed in language specific to structural features and/or methodological acts, it is to be understood that the subject matter defined in the appended claims is not necessarily limited to the specific features or acts disclosed above. Rather, the specific features and acts described herein are disclosed as illustrative implementations of the claims.

The invention claimed is:

1. A wire reel comprising:

a casing defining a wire spool aperture and a wire window;

a cover adapted to removably attach to the casing via a releasable attachment mechanism and to substantially close the wire spool aperture and defining a perimeter, the releasable attachment mechanism further comprising a ball bearing and a spool release pin configured to cause the ball bearing to disengage a recess defined b the casing;

a wire hub adapted to spool wire into or out of the wire spool aperture via the wire window, the wire hub being coupled to the cover;

a winding lever operably coupled to the cover and movable between a stowed position in which the winding lever is substantially adjacent to the cover and within the perimeter of the cover and a deployed position in which the winding lever extends beyond the perimeter of the cover;

a buckle adapted to accept a belt and to removably attach to the casing; and a wind knob coupled to the winding lever at a distal end of the winding lever, the cover defining a knob aperture through which the wind knob extends when the winding lever is in the stowed position.

2. A wire reel comprising:

a cover adapted to removably attach to a wire reel casing via a releasable attachment mechanism further comprising a ball bearing and a spool release pin configured to cause the ball bearing to disengage a recess defined by the casing, the cover being further adapted to substantially close a wire spool aperture of the wire reel casing, the wire reel casing defining a perimeter;

a wire hub adapted to spool wire into or out of the wire spool aperture via a wire window defined by the wire reel casing, the wire hub being coupled to the cover; and a winding lever operably coupled to the cover and movable between a stowed position in which the winding lever is substantially adjacent to the cover and within the perimeter of the cover and a deployed position in which the winding lever extends beyond the perimeter of the cover.

3. The wire reel of claim 2 wherein the wire hub is square.

4. The wire reel of claim 2 further comprising a mounting base adapted to accept a belt and to removably attach to the casing.

5. The wire reel of claim 4 wherein the mounting base is further adapted to removably attach to the casing via a rotation of the casing relative to the mounting base.

6. The wire reel of claim 2 wherein the cover is further adapted to removably attach to the casing via a translational move relative to the casing along a central axis defined by the cover.

7. The wire reel of claim 2 wherein the cover and winding lever define a hinge about which the winding lever can pivot.

8. The wire reel of claim 2 wherein the winding lever further comprises a wind knob at a distal end of the winding lever.

9. The wire reel of claim 8 wherein the cover defines a knob aperture through which the wind knob extends when the winding lever is in the stowed position.

10. The wire reel of claim 2 further comprising a detent adapted to retain the winding lever in the stowed position.

11. The wire reel of claim 10 wherein the wire hub further comprises the detent and the detent engages the winding lever when the winding lever is in the stowed position.

12. A wire reel comprising:

a casing defining a wire spool aperture and a wire window;

a cover releasably attachable to the casing via a releasable attachment mechanism and being adapted to substantially close the wire spool aperture when attached to the casing, the releasable attachment mechanism further comprising a ball bearing and a spool release pin configured to cause the ball bearing to disengage a recess defined by the casing; and a hub coupled to the cover and being positioned on the cover such that when the cover is releasably attached to the casing the wire hub is positioned in the wire spool aperture to spool wire into or out of the wire spool aperture via the wire window.

13. The wire reel of claim 12 wherein the cover defines a perimeter and wherein the cover further comprises a winding lever, the winding lever being movable between a stowed position in which it is generally adjacent to the cover and within the perimeter of the cover and a deployed position in which it extends beyond the perimeter of the cover.

14. The wire reel of claim 13 wherein the casing, cover, and winding lever define a generally arcuate perimeter which is free of protrusions.

15. The wire reel of claim 12 wherein the cover further comprises a winding lever which further comprises a wind knob at a distal end of the winding lever.

16. The wire reel of claim 15 wherein the cover defines a knob aperture through which the wind knob extends when the winding lever is in the stowed position.

17. The wire reel of claim 15 further comprising a detent adapted to retain the winding lever in the stowed position.

18. The wire reel of claim 17 wherein the wire hub further comprises the detent.

19. The wire reel of claim 12 wherein the cover and the hub are one of a plurality of interchangeable wire spools.

* * * * *